US006759808B2

(12) United States Patent
Grotjohn et al.

(10) Patent No.: US 6,759,808 B2
(45) Date of Patent: Jul. 6, 2004

(54) MICROWAVE STRIPLINE APPLICATORS

(75) Inventors: Timothy A. Grotjohn, Okemos, MI (US); Jes Asmussen, Okemos, MI (US); Andy Wijaya, Cambridge, MA (US)

(73) Assignee: Board of Trustees of Michigan State University, East Lansing, MI (US)

( * ) Notice: Subject to any disclaimer, the term of this patent is extended or adjusted under 35 U.S.C. 154(b) by 0 days.

(21) Appl. No.: 10/280,142

(22) Filed: Oct. 25, 2002

(65) Prior Publication Data

US 2003/0080685 A1 May 1, 2003

Related U.S. Application Data

(60) Provisional application No. 60/343,857, filed on Oct. 26, 2001.

(51) Int. Cl.[7] ..... H01J 7/24

(52) U.S. Cl. ..... 315/111.71; 315/111.21; 315/111.91; 315/39.65; 315/39.69; 313/231.31; 118/723 R

(58) Field of Search ..... 315/111.21, 111.71–111.91, 315/39.3, 39.51, 39.65, 39.69; 313/231.31, 362.1; 118/723 R, 723 I

(56) References Cited

U.S. PATENT DOCUMENTS 4,507,588 A * 3/1985 Asmussen et al. ..... 315/39
4,585,688 A * 4/1986 Nakamura et al. ..... 428/200
4,630,566 A * 12/1986 Asmussen et al. ..... 118/50.1
4,727,293 A * 2/1988 Asmussen et al. ..... 315/111.41
5,081,398 A * 1/1992 Asmussen et al. ..... 315/111.41
5,844,376 A * 12/1998 Lapatovich ..... 315/248
5,942,855 A * 8/1999 Hopwood ..... 315/111.51
6,326,739 B1 * 12/2001 MacLennan et al. ..... 315/248

FOREIGN PATENT DOCUMENTS

DE 19851628 5/2000

OTHER PUBLICATIONS

Fritz, R., M.S. Thesis, Michigan State University, East Lansing, MI (1978).
Asmussen, J., Thesis, University of Wisconsin(1967).
Asmussen, J., et al., Appl. Phys. Letters 11, 324–326 (1967).
Asmussen, J., et al., IEEE Trans. Electron Devices, ED–16, 18–29 (1969).
Asmussen, J., et al., IEEE Trans. In Plasma Science, PS–25, 1196–1221 (1997).
Popov, G., High Density Plasma Sources, Chap. 6, Noyes Pub.(1996).
Lieberman, M.A., et al., Principles of Plasma Discharges . . . , Chap. 12, John Wiley & Sons, (1994).
Yin, Y., et al., Miniaturization of inctively Coupled . . . , IEEE Trans. Plasma Sci, 27, 1516–1524.
Lee, Q.H., An Experimental Study of Nonlinear Phenomena . . . , Ph.D. Thesis, MSU (1970).
J. Asmussen and J.B. Bayer, Appl. Phys. Letters, 11, 324–326 (1967).
Tonks, Phys. Rev. 37, 1458 (1931).

* cited by examiner

*Primary Examiner*—Haissa Philogene
(74) *Attorney, Agent, or Firm*—Ian C. McLeod

(57) ABSTRACT

An apparatus and method which maintains plasma discharges (for instance 25) in containers (for instance 20) which have an internal section of 1 cm or less in width are described. The very small cross-section plasma discharges are useful in MEMS devices, in spectrometers and in spectroscopy.

25 Claims, 9 Drawing Sheets

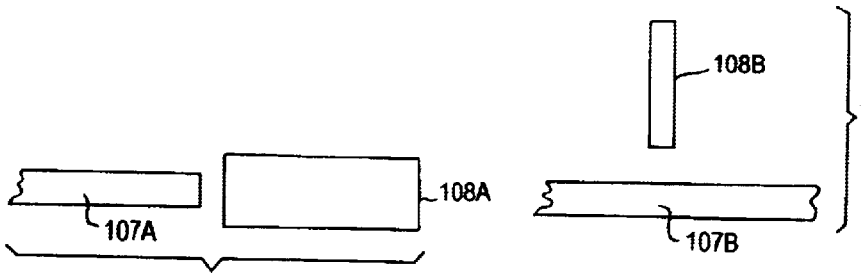
FIG. 11A
FIG. 11B
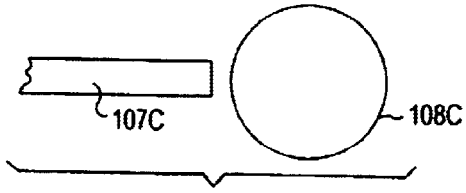
FIG. 11C
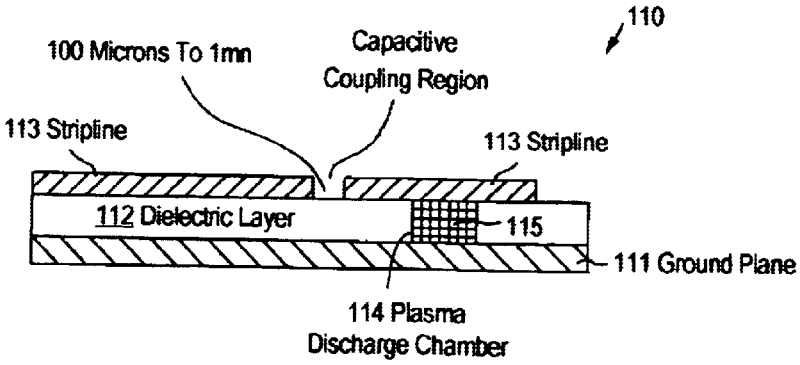
FIG. 12

MICROWAVE STRIPLINE APPLICATORS

CROSS REFERENCE TO RELATED APPLICATION

This application claims priority to Provisional Application Serial No. 60/343,857, filed Oct. 26, 2001.

GOVERNMENT RIGHTS

The present invention was sponsored by the National Science Foundation Grant No. 61-2027. The U.S. Government has certain rights to this invention.

BACKGROUND OF THE INVENTION (1) Field of the Invention

The present invention relates to stripline microwave applicators particularly for creation and maintenance of mini and micro microwave (plasma) discharges. The apparatus and methods described are directed toward efficiently creating and precisely controlling very small microwave discharges (plasmas). These discharges have typical physical dimensions, d, that are less than a millimeter and as small as a few tens of microns. The free space wavelength, $\lambda$, of microwave energy (300 MHz–30 GHz) varies from one meter to one centimeter and thus $\lambda$ is much greater than d throughout the entire microwave frequency spectrum. In particular, the present invention relates to an apparatus wherein the stripline conductors that couple microwave energy are transverse to the microwave discharge, and preferably with a container for generating the plasma so that the plasma extends beyond the stripline excitation region.

(2) Description of Related Art

It is also well known that a condition for the existence of a plasma discharge is that $d>(6–10)\lambda_{DE}$ where $$\lambda_{DE} = 743\sqrt{\frac{T_e}{n_e}}\ Cm,$$

$T_e$ is the electron temperature in volts, and $n_e$ is the electron density in electrons per $cm^3$. This criteria implies that to produce very small plasmas (discharges) high densities and low electron temperatures are desirable. For example to create 100 micron size microwave plasmas the Debye length, $\lambda_{DE}$, must be approximately 10–15 microns. If $T_e$~4 volts then $n_e \gtrsim 10^{12}\ cm^{-3}$. If d~10 microns and if $T_e$~1 volts, then $n_e \gtrsim 10^{14}\ cm^{-3}$. Thus very small discharges require low electron energies and high charge densities, and are as a result very intense discharges that have very high absorbed power densities ($W/cm^3$). Despite the required high power densities the total absorbed power of these discharges is very low, i.e. of the order of a few watts or less.

The high density $n_e$ requirement of these very small microwave plasmas implies that $n_e >> n_c$ where $n_c$ is the critical density. The critical density $n_c$ is defined as the density where, f, the excitation frequency is equal to the plasma frequency, $f_{pe}$. That is when $$f=f_{pe}=8980\sqrt{n_c}Hz$$

where $n_c$ is in units of $cm^{-3}$. Very small plasmas require very high electron densities, $n_e$. Thus $n_e >> n_c$. Therefore, the microwave plasma will be over dense, and as a result the electromagnetic energy will not freely propagate through the discharge, but will exist in a thin discharge surface layer equal to about the skin depth, $\delta_c$, where $$\delta_c = \left(\frac{2m\nu_{eff}}{\omega\mu_o e^2 n_e}\right)^{1/2} = \frac{c}{\omega_{pe}}\left(\frac{2\nu_{eff}}{\omega}\right)^{1/2}$$

However, for very small discharges $\delta_c$>d.

This condition indicates that higher excitation frequencies will more readily produce higher density discharges. The required high densities also impose conditions on discharge pressure. To readily achieve the required high densities it is desirable to operate these discharges at moderate pressures ($\gtrsim$Torr) to higher pressure environments (one or more atmospheres) where high species densities are available and where $\nu_{eff}/\omega$ is greater than one thereby insuring some electromagnetic energy penetration within the discharge.

Mechanisms of coupling energy into microwave discharges vary with pressure. At low pressure the effective electron collision frequency, $\nu_{eff}$, is much less than $\omega$. Thus energy coupling takes place primarily via stochastic heating and resonant wave/collisionless heating mechanisms. These mechanisms include such phenomena as electrons impinging on the oscillating sheath edge and wave particle interactions that occur in electroacoustic wave/surface wave plasma interactions. As the pressure is increased $\nu_{eff}$ increases and thus electromagnetic/discharge coupling takes place via an electron collisional process, i.e. ohmic heating.

Early microwave discharge experiments demonstrated the formation of relatively small discharges with dimensions of a few mm or larger and with microwave absorbed power levels of a few Watts or more (Fritz, R., M. S. Thesis, Michigan State University, East Lansing, Mich. (1978); and Asmussen, J., Thesis, University of Wisconsin (1967); Asmussen, J., et al., Appl. Phys. Letters 11, 324–326 (1967); Asmussen, J., et al., IEEE Trans. Electron Devices, ED-16, 19–29 (1969)). During the period of these experimental investigations it was envisioned that the practical application of microwave discharges required discharges with typical dimensions of several centimeters or more. Thus research efforts were directed toward development of applicator coupling techniques that created and maintained large volume, high density discharges with dimensions of 8.0–40 cm. These efforts resulted in a variety of microwave discharge configurations such as those described in Asmussen, J., et al., IEEE Trans. In Plasma Science, PS-25, 1196–1221 (1997); and Popov, G., High Density Plasma Sources, Chapter 6, Noyes Pub. (1996)) and in U.S. Pat. Nos. 4,507,588; 4,585,688; 4,630,566; 4,727,293 and 5,081,398 to *Asmussen.*

Using this technology with 2.45 GHz excitation, large volume discharges were created strategically locating the bounded plasma volume within the applicator. The optimal location of the discharge volume allowed the discharge to be exposed to a relatively large region (in comparison to the excitation wavelength) of applied electromagnetic field. Additionally the applicator had to be adjustable to enable first the ignition of the discharge and then the efficient matching of high power (100-thousands of watts) into the high density plasma. Then these applicator/discharge configurations were scaled up by decreasing the excitation frequency to 915 MHz. These techniques were successful in creating uniform microwave plasmas over a pressure regime of a few millimeters to over 200 Torr with dimensions of 10–35 cm.

However, the applicator technologies that were developed to create large discharges, are not optimal for the formation of small discharges. If the excitation frequency is raised the waveguide and cavity applicators become smaller and thus become more difficult to fabricate.

One method of producing high density discharges is by the use of rf inductive plasma coupling via planar or helical coils (Lieberman, M. A., et al., "Principles of Plasma Discharges and Materials Processing," John Wiley and Sons, (1994)). Inductive coupling results in the noncapacitive power transfer to the charged species of this discharge, thereby achieving a low impressed voltage across all plasma sheaths at electrode and wall surfaces. These high density plasma sources are typically excited by 13.56 MHz rf energy and are capable of producing large 10–40 cm diameter discharges with densities in excess of $10^{12}$ $cm^{-3}$. Thus $n_e >> n_c$ and $\lambda >> d$ and their behavior can be understood by quasistatic electromagnetic analysis. These discharges represent an important method of electromagnetic/plasma excitation, i.e. quasistatic inductive excitation.

Recently, Hopwood et al has scaled these inductive planar discharges down to very small dimensions (Yin, Y., et al., "Miniaturization of Inductively Coupled Plasma Sources," IEEE Trans. Plasma Science, 27, 1516–1524 (1999)). See also U.S. Pat. No. 5,942,855 to Hopwood for a small plasma generator. Small planar coils of 5–15 mm diameter were fabricated and were excited with 100–460 MHz rf energy. These small discharges demonstrated the ability of inductive coupling at high frequencies to sustain small high density plasmas. Microfabrication techniques were used to fabricate the small planar inductive coils. However, these experiments indicated that as rf frequency was increased the coupling efficiency decreased. Small plasmas required high plasma densities which in turn require high excitation frequencies (~1–5 GHz) and the fabrication of smaller inductive coils that must operate at higher and higher current and power densities. It was suggested that the power density and coupling efficiency will prevent the application of this quasistatic excitation method to plasmas smaller than ½–1 mm.

Another microwave applicator that is capable of producing very small microwave discharges is the coaxial applicator shown in FIG. 1. The applicator consists of an outer conductor with inner diameter of 2.2 cm and a center conductor with a diameter of approximately 1 cm. As shown, the discharge is ignited and sustained in a break or gap in the center conductor. The capacitive gap of approximately 1–5 cm is filled with a plasma and thus this type of discharge is often referred to as a plasma capacitor (Lee, Q. H., "An Experimental Study of Nonlinear Phenomena in a Resonantly Sustained Microwave Plasma," Ph.D. Thesis, Michigan State University (1970); Asmussen, Ph.D. Thesis, University of Wisconsin (1967); J. Asmussen and J. B. Beyer, Appl. Phys. Letters, 11, 324–326 (1967); J. Asmussen and J. B. Beyer, IEEE Trans. Electron Devices, ED-16, 19–29 (1969)). Small, 1 cm diameter by 1–2 mm, high density ($10^{11}$–$10^{12}$ $cm^{-3}$) plasma capacitive discharges have been created by this applicator. While this applicator has the ability to create very small discharges it is unlikely that the coaxial applicator can be scaled down to dimensions that enable its fabrication on a chip.

In 1931, Tonks (Phys. Rev. 37, 1458 (1931); Phys. Rev. 38, 1212 (1931)) observed the phenomenon called plasma resonance oscillations, in a bounded uniform plasma when the plasma frequency $\omega_{pe}$ is greater than the excitation frequency. Since that time this oscillation was observed in many experiments (Parker, J. V., et al., Phys. Of Fluid, 7, 1489 (1964); Phys. Rev. Letters, 11.183 (1963); and Taillet, J., Am J. Phys., 37, 423 (1969)) and has been identified as a space charge oscillation in a bounded plasma, and is now identified as a "cold plasma resonance." In 1951 Romell (Romell, D., Nature, 167, 243 (1951)) observed that a cylindrical plasma discharge when subjected to microwave scattering exhibited a main cold plasma resonance and a series of weaker resonances which are not predicted by the uniform, cold plasma model of Tonks. Since then these additional dipolar resonances have often been referred to as "Tonks-Dattner" or "T-D" resonances.

Many years later the observed cold plasma and T-D resonance spectrum was finally theoretically explained with the use of a plasma theory that included the thermal motion of the plasma electron gas, and allowed the existence of electron plasma waves. Additionally the bounded plasma nonuniformity, i.e. the plasma density profile influenced the exact location of these resonances. Good agreement between theory and experiment was achieved (Parker, J. V., et al., Phys. Of Fluid, 7, 1489 (1964); Phys. Rev. Letters, 11.183 (1963)) when a plasma density profile corresponding to the Tonks-Langmuir (Tonks, L., et al., Phys. Rev., 34, 876 (1929)) model was included. The calculated resonances showed excellent quantitative agreement with experiments for the main (cold plasma) and the first two temperature resonances. More recently, W. M. Leavens (Leavens, W. M., Radio Science, 69D, 10, (1964) 1321; Phys. Fluid, 10, 2708 (1967)) and D. E. Baldwin (Phys. Fluid, 12, 279 (1969)) developed a kinetic model for the temperature resonances. In both cases, Landau damping (collisionless damping), which is present near the tube wall is included in the analysis. Experimental confirmation was made without choosing the electron temperature for the best fit.

During the 1970–1980 period a number of investigators demonstrated that one could efficiently couple microwave energy into and sustain a discharge if this energy was coupled into these plasma resonances. In fact if enough power was available a microwave discharge could be sustained at the cold plasma resonance or at the first or second T-D resonance. These microwave discharges were identified as resonantly sustained discharges. Microwave discharges were formed in waveguide (Lee, Q. H., "An Experimental Study of Nonlinear Phenomena in a Resonantly Sustained microwave Plasma," Ph.D. Thesis, Michigan State University (1970)) and cylindrical coaxial cavity applicators (Fredericks, R. M., et al., "Retuning and Hysterisis effects of a rf plasma in a variable size microwave cavity," Appl. Phys. 42, 3647–3649 (1971); Fredericks, R. M., et al., "A High density resonantly sustained plasma in a variable length cylindrical cavity," Appl. Phys. Letters, 19, 508–510 (1971); Asmussen, J., et al., Proc. IEEE 62, 109 (1974); and Asmussen, J., Ph.D. Thesis, University of Wisconsin (1967); J. Asmussen and J. B. Beyer, Appl. Phys. Letters, 11, 324–326 (1967); J. Asmussen and J. B. Beyer, IEEE Trans. Electron Devices, ED-16, 19–29 (1969)) and were maintained inside these applicators via coupling to the electromagnetic resonances of the plasma loaded applicator. When the experimental conditions were appropriately adjusted microwave discharges were created by coupling either to the cold plasma resonances of the discharge geometry or to the "T-D" traveling wave resonances (Rogers, J., and J. Asmussen IEEE Trans on Plasma Science PS-10, 11–16 (1980); Fredericks, R. M., Ph.D. Thesis, MSU (1971); and Fritz, R., M. S. Thesis, Michigan State University (1978)).

Bilgic et al (Plasma Sources Sci. Technol. 9, 1–4 (2000)) were the first to describe a stripline applicator for producing a plasma and applied it to atomic emission spectrometry. This research is also evidenced in DE19851628. In this application the stripline applicator is parallel to the container. This particular microwave stripline system couples microwave power into a plasma loaded applicator resonance.

Objects

It is an object of the present invention to provide improved stripline applicators for generating a plasma discharge. It is particularly an object of the present invention to provide applications which are inexpensive to manufacture and which operate effectively. These and other objects will become increasingly apparent by reference to the following description.

SUMMARY OF THE INVENTION

This invention has several unique features beyond the prior art. First, it employs microwave stripline applicator technology to create and maintain discharges/plasmas. However the microwave applicator coupling technology described herein is fundamentally different from that recently described by Bilgic et al.

Bilgic et al describes a plasma loaded applicator where the plasma discharge and the stripline coupling structure form an interdependent microwave resonant circuit. The plasma discharge is created and maintained physically inside the stripline applicator, and the stripline electromagnetic fields are impressed over the entire discharge volume, i.e. applicator electromagnetic excitation occurs over the entire discharge. Thus this stripline applicator coupling method is similar to earlier developed, nonstripline applicators and therefore has some of the same fundamental limitations such as limited discharge variability, stability problems, difficulty in matching, and the need for variable tuning. The discharge is located only inside the applicator and thus the discharge size is also limited to the applicator size.

The Bilgic apparatus limits the plasma size to the stripline applicator. Optimal coupling to the discharge loaded stripline applicator occurs when the plasma loaded stripline applicator's impedance matches or closely matches the input transmission line characteristic impedance. This usually occurs at or near a plasma loaded applicator resonance and often also requires additional external stripline matching stubs for versatile operation. Since the plasma loaded applicator resonance is dependent on the plasma characteristics, such as the average density, the density profile, the effective electron collision frequency, etc., the discharge matching and the discharge stability are very sensitive to changes in external operating conditions such as variations in pressure, input power, gas flow, gas type, and even slight changes in excitation frequency. Some of these limitations can be overcome by adding the appropriate variable tuning as has been utilized in earlier nonstripline applicator designs (See U.S. Pat. Nos. 4,507,588; 4,585,688; 4,630,566; 4,727,293 and 5,081,398 to Asmussen). However, variable tuning may be difficult to achieve and thus may be impractical in microwave stripline applicators.

Unique features of this invention are the microwave coupling to a plasma resonance, the ability to produce stable and matched discharges, and the ability to create discharges external to the microwave coupling region. Coupling to a discharge plasma resonance is excitation frequency insensitive. Thus discharges can be created and maintained with a variety of stripline applicators, which vary from unmatched, nonresonant, stripline circuits to perfectly matched plasma loaded resonant circuits. In all cases the microwave excitation zone occurs in a relatively localized coupling region of the applicator. Microwave energy is coupled into the discharge via a plasma resonance that can be (1) a localized plasma geometric resonance, i.e. a plasma space charge oscillation at the discharge geometric resonant frequency, and (2) either a plasma standing wave or a traveling wave that exists along the discharge container. In the later case the plasma volume increases with an increase in microwave power to a size that far exceeds the applicator excitation region. Then the discharge occupies a volume that is mostly outside the stripline applicator excitation zone. Thus the excitation of standing and traveling waves allows the formation of discharges on curved and multiple channel discharge containers.

The coupling to a plasma resonance produces a stable, matched discharge that is able to be maintained continuously as pressure, gas mixture and flow rate and input power are all varied over a wide range. For example if sufficient power is available, the discharge can be sustained from a few mTorr to over one atmosphere. The flow rate can be varied from no flow to 1000's sccm. Under certain operating conditions it may be desirable to add external impedance matching to the microwave stripline circuit, but it usually is not absolutely necessary. The resulting microwave coupling system is operationally robust and versatile i.e. it is energy efficient, stable and adaptable to wide variations in operating conditions, and can be scaled to small dimensions.

One of the unique aspects of this disclosure is the microwave electric fields are used to couple the microwave energy into the discharge plasma's natural space charge oscillations or electron plasma oscillations. Because of the small size of the applicator the coupling can be understood as a quasistatic coupling, i.e., like a resonant plasma capacitor. These natural resonant frequencies that the stripline applicator excites will generally be the natural resonant frequencies of cylindrical or spherical plasmas.

The coupling in these stripline applicators can be to either standing waves or traveling waves where the plasma frequency is greater than the excitation frequency, i.e. for high density plasmas, i.e. the plasma density is greater than the critical density.

A key concept is that the stripline applicator is used to couple to plasma resonances. The plasma resonance can be either a stationary standing wave or traveling wave. In the case of traveling plasma waves the plasma can grow to a size far exceeding the applicators high electric field excitation region.

The method of coupling microwave energy into the discharge that is employed in this invention is coupling via a plasma resonance that is dependent on the geometry of the discharge. For example, common discharge geometries are spherical, cylindrical and even parallel plate plasma slabs. Again, in this type of electromagnetic/plasma coupling the excitation electromagnetic wavelength, $\lambda$, is much larger than the typical physical length, d, of the discharge, i.e., $\lambda >> d$. The electromagnetic field creates the discharge by exciting a geometric plasma resonance. This plasma resonance involves exciting inductive space charge oscillations or electron plasma oscillations within the discharge volume. These inductive plasma oscillations then resonate with the capacitive fields that exist in the surrounding exterior of the discharge.

The discharge is held in an ionized state where the electron density, $n_e$, is higher than the critical density $n_c$, i.e. $n_e >> n_c$ and $\omega_{pe} >> \omega$ where $\omega$ is $2\pi$ times the excitation frequency. When at resonance the discharge electron/ion densities are related to the geometry of the discharge. For example for a long cylindrical rod discharge $$\left(\frac{\omega_{pe}}{\omega}\right)^2 = 2 \text{ and for spherical discharge}$$

$$\left(\frac{\omega_{pe}}{\omega}\right)^2 = 3.$$

When the enclosing cylindrical dielectric constant of the discharge container is included in the calculation then this relationship becomes $$\left(\frac{\omega_{pe}}{\omega}\right)^2 = (1 + K_{eff})^{1/2}$$

where $K_{eff}$ is the effective dielectric constant of the container. These relationships represent two dimensional geometric resonances. However, if the cylindrical discharge volume is long, then plasma waves can propagate along the axis of the cylinder. Examples of these guided waves are Gould-Trivelpiece modes (cold plasma modes) and electron plasma waves (or sometimes called electroacoustic waves). Each of these modes will have a guided wavelength, $\lambda_g$, that depending on the plasma temperature and density, and the cylindrical dimensions, could vary from several millimeters to several centimeters. When the axial length of the cylinder is equal to $\lambda_g/2$, $\lambda_g$, $3\lambda_g/2$, etc. a three dimensional plasma resonator is created by exciting standing waves along the cylindrical axis of the plasma.

Thus when exciting discharges with this technique cylindrical discharges with very small cross sectional dimensions are created and sustained. Then as more power is coupled they grow axially and fill the cylinder becoming a cylindrical plasma resonator. Example dimensions are cylindrical radii of ½ mm to 50 microns while the length is larger than several centimeters. One unique feature of this invention is the direct coupling to a plasma resonance related to the plasma loaded container geometry. This coupling scheme does not require a resonant electromagnetic circuit.

Thus the present invention relates to an apparatus for maintaining microwave plasma discharges which comprises:

a microwave discharge container having an internal section of 1 cm or less in width, which container is positioned in a dielectric material between conductors which serve as a wave guide for the microwaves and as plates for providing an electrical field with an electrically conductive stripline less than about 3 mm thick and less than 2 cm wide providing one of the plates mounted on the container transverse of the cross-section, wherein the plasma is maintained inside the container by a combination of the microwaves and the electrical field in the presence of a gas which forms the plasma which is beyond the width of the stripline.

The container is preferably a tube which has a length which is longer than the width and wherein the tube can extend outside of the dielectric material.

The stripline conductor is preferably a strip of a conductive metal mounted on the dielectric material which is a solid and adjacent the container and wherein another of the conductors mounted on the dielectric material is a ground plate. The conductor ground plate is preferably a strip of metal which has a length which is greater than the width of the container.

The container is preferably a sphere. The dielectric material can be a gas or a solid. Preferably the plasma discharge is excited so that the discharge is maintained by plasma resonance.

The present invention also relates to a method for producing a plasma discharge, the improvement which comprises exciting the discharge in an apparatus which comprises a microwave container having an internal section of 1 cm or less in width, which container is positioned in a dielectric material between conductors which serve as a guide for the microwaves and as plates for providing an electrical field with an electrically conductive stripline less than about 3 mm thick and less than 2 cm wide providing one of the conductor plates transverse of the container cross-section, wherein the plasma is maintained inside the container by microwave energy in the presence of a gas which when ionized forms the plasma in the container.

Optionally the container is placed in a gap of the stripline conductor and the gap length is less than $\lambda/8$.

Optionally one or more discharges are present at power levels less than 100 w for pressures in the container from 0.01 Torr to above one atmosphere.

Optionally the plasma discharge extends beyond the width of the stripline conductor, so that microwave excitation by the direct stripline conductor occupies a small fraction of a discharge volume in the container and wherein optionally there is a gap in the stripline and the gap is less than $\lambda/8$.

Optionally a portion of the container is placed in the electric field created by the stripline conductor.

Optionally where the conductor is shaped and sized to form a resonant element which produces electric fields in all or a portion of the container.

Optionally the container on one or both sides of the stripline conductor divides into two or more container sections or branches so that the plasma discharge fills the two or more container sections or branches.

Optionally the gas can be flowing through the container or stagnant.

Optionally the conductor is shaped and sized to form a resonant element which produces electric fields in all or a portion of the container and where a resonant and matching structure is created by the addition of tuning circuits between the microwave power supply and resonant element.

Optionally the microwaves are supplied directly to the stripline structure without any matching elements.

Optionally the container sections are in curved or bent shapes.

Optionally the stripline conductor is terminated in an electrical or mechanically tunable adjustable load.

Optionally a tunable element is adjusted for plasma discharge ignition and maintenance and the stripline conductor is terminated in an electrically or mechanically adjustable load.

Optionally an amount of power input is used to control a region or length of the container occupied by the discharge.

Optionally there is more than one of the apparatus that are arranged in an array pattern.

Optionally individual discharges are powered from a single source for the microwaves.

Optionally there are more than one of the apparatus, where individual discharges are powered from a single source for the microwaves and where the individual discharges are sustained by coupling from discharge to discharge.

The plasma discharge in the container can be ignited a number of ways. The ignition process is one of first creating some free electrons that can be heated in the applied microwave electric field formed by the stripline applicator. Specific techniques for ignition include providing a high voltage spark to the discharge container, providing a high microwave electric field to the container by applying an initial high input microwave power, and by shining ultraviolet light into the discharge container region.

BRIEF DESCRIPTION OF THE DRAWINGS

FIGS. 11A to 11C are top views showing in black the various stripline resonators/tubes 107A, 107B, 107C and their position relative to the stripline conductor 108A, 108B, 108C which are not shaded.

FIG. 12 is a side view of an applicator 110 with stripline 113, ground plane 111, dielectric 112, container 114 and plasma 115.

DESCRIPTION OF PREFERRED EMBODIMENTS

Figure 1:
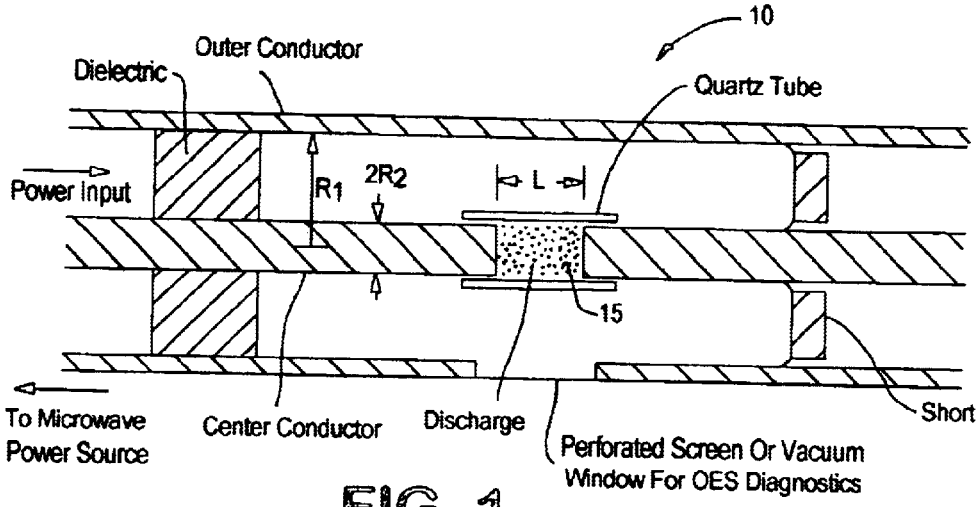
FIG. 1 is a cross-sectional view of a prior art small coaxial plasma 15 source.
Figure 2A:
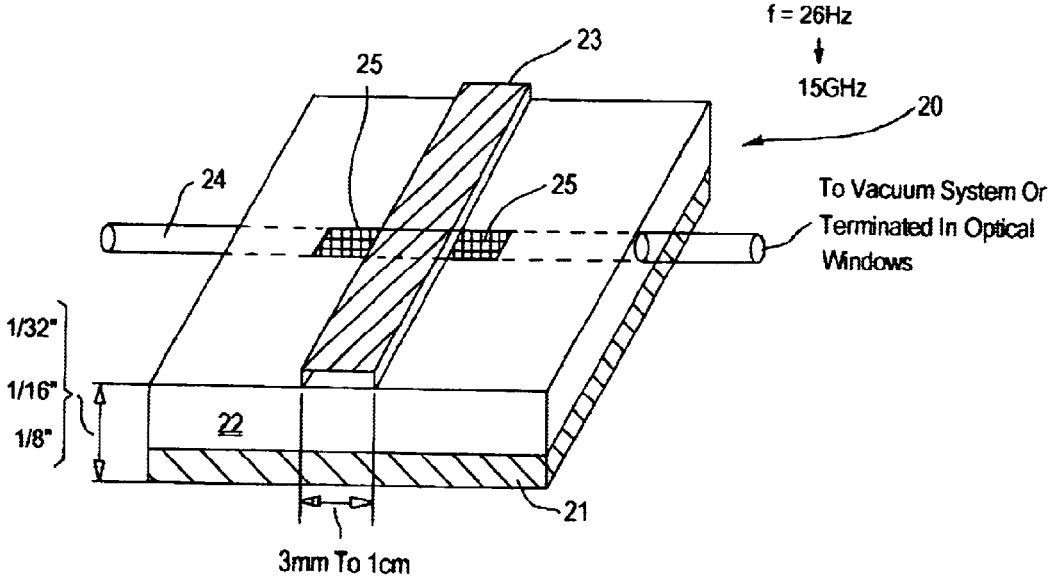
FIG. 2A is a perspective view of a parallel conductor excitation applicator 20 of the present invention where a stripline 23 excites a plasma 25 in the tube 24.
Figure 2B:
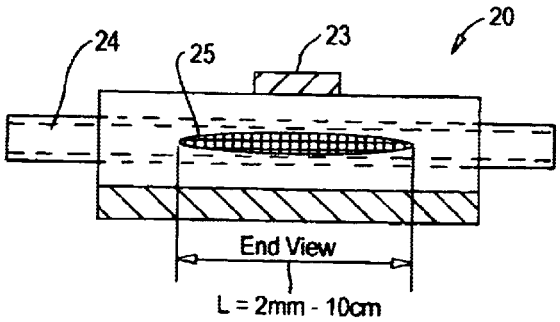
FIGS. 2B and 2C are end and side views of FIG. 2A. The tube 24 has a diameter D of 5 mm to 50 microns ($50\times10^{-6}$ m).
Figure 2C:
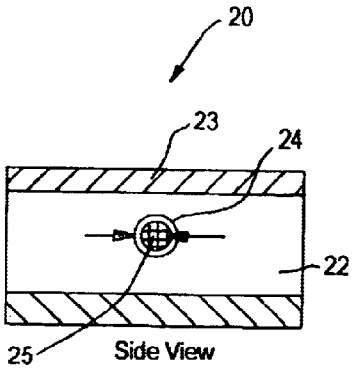

The present invention relates to new applicator technologies that enable the excitation of very small microwave discharges. Discharge dimensions range from a few millimeters down to or even less than a few hundred microns. Additionally the applicator technology that is described utilizes stripline circuits and coupling techniques. Thus excitation frequencies can vary from a few 100 MHz to 10–30 GHz, and possibly even higher frequencies. Microwave applicator geometries are described that enable the matching and focusing of microwave energy into very small volumes. Since $\lambda >> d$ the electromagnetic focusing can be understood by using transmission theory and quasistatic electromagnetic circuit models.

The possibility of higher frequency excitation has the additional benefit of creating discharges with very high plasma densities. For example, if plasma resonators are formed where $$\left(\frac{\omega_{pe}}{\omega}\right)^2 = 2$$

then the excitation of the discharge at 10 to 30 GHz will create a plasma with a density of approximately 100 times the density of a 2.45 GHz excited discharge. Thus the discharge Debye length, $\lambda_{DE}$ will be decreased by a factor of ten. Since plasma dimensions are limited to $\sim(6\text{–}10)\lambda_{DE}$ the smaller $\lambda_{DE}$ will enable the formation of smaller discharges.

This invention describes apparatus and methods that enable the ignition and maintenance of mini and micro microwave discharges. Mini and micro discharges are defined here as discharges that have characteristic physical dimensions, d, that are of the order of or less than a few millimeters. The dimensions can be as small as a few micrometers if the discharge Debye length $\lambda_{DE}$, is less than d/6–d/10. In contrast to the conventional methods of creating and maintaining microwave discharges that utilize waveguide and cavity applicators, this invention utilizes microstrip transmission line circuits to create and maintain the mini/micro discharges. Therefore these techniques enable the formation of very small discharges and also enable the excitation of these discharges with very high frequency microwave (≧10 GHz–30 GHz) energy. Miniature microwave discharges such as these are electrodeless, which allows the plasma to operate with a lower contamination level and longer lifetime than electrode based plasmas. The application of these discharges are numerous. They range from mini/micro plasma assisted CVD deposition, and etching reactors, to mini/micro propulsion systems, to very small, intense light sources and also to a variety of applications of "plasmas on a chip," such as mini vacuum pumps and mini gas flow controllers, to plasma sources for optical emission spectrometers which can be combined with additional integrated circuits and MEMS and placed on a single chip.

Electromagnetic coupling to bounded plasma resonances occurs when the discharge dimensions, d, are small in comparison to the free space wavelength, $\lambda$, and the waveguide mode wavelength, $\lambda_g$, i.e. where $\lambda$ and $\lambda_g >> d$. The discharges are formed inside a discharge container that is transparent to electromagnetic radiation and the discharge itself assumes a shape that is controlled by the container boundaries. While these discharges can assume any shape that is defined by the container this invention disclosure discusses coupling principles and applicator technology that use simple discharge shapes, i.e. cylindrical, spherical and plasma slab (parallel plate) geometries. In each of these geometries at least one container dimension, d, is much less than $\lambda_g$ and $\lambda$.

The discharge can be formed and sustained over a wide pressure regime from a few millitorr to over one atmosphere. The discharge behavior varies considerably over this pressure regime. At low pressures (often identified as the Langmuir regime) ion and electron transport are collisionless. Discharges fill the discharge container and thus take on the shape of the container. In contrast at very high pressures species diffusion is highly collisional and volume recombination of radicals and even ions and electrons take place. Thus the discharge pulls away from the walls and neutral gas heating occurs. The discharge then assumes a shape related to the spatial variation of the electromagnetic field, the gas flows and the bounding/stabilizing container walls. In these high pressure discharges the neutral gas temperature is in excess of 1000° C. and discharge energy is transported to the walls by heat conduction in the neutral gas.

The low pressure and high pressure coupling mechanisms require a different polarization of the electric field for optimum coupling. At low pressure the electric field must be parallel to the discharge density gradients for optimum coupling, while at high pressure for optimum coupling it is desirable to have a component of the electric field tangential to the discharge boundary. Thus applicator designs presented in this invention are adaptable to both these optimal coupling conditions as the discharge pressure is varied. The two basic applicator configurations presented in FIGS. 2–5 display stripline applicators that are capable of efficiently coupling to mini and micro plasma microwave discharges. The discharges can be continuously sustained over a very wide pressure (3–4 milliTorr-1 atmosphere) region with little adjustment of the microwave circuit.

FIGS. 2A, 2B, 2C, 3A and 3B, 4A and 4B and 5A and 5B display embodiments of this invention. They utilize microstrip transmission line applicators to ignite and sustain the microwave discharges. Common final integers are used for common elements. In the first concept, which is displayed in FIGS. 2A to 4B a microwave discharge 25, 35 or 45 is formed in a bounded discharge container 24, 34 or 44 that is placed between the ground plane 21, 31 or 41 and a strip conductor 23, 33 or 43. Thus this configuration is said to exhibit parallel microwave excitation coupling. The discharge container can assume any shape, for example cylindrical, as is shown in FIGS. 2A to 4B, or spherical or parallel plate, as long as its dimensions are much less than $\lambda$ and $\lambda_g$. The discharge container is appropriately placed in the dielectric substrate 22, 32 or 42 to achieve efficient coupling of microwave energy into the plasma loaded discharge container. As is indicated in FIGS. 2A to 4B, when desired the discharge container can be connected to a vacuum system which controls the discharge pressure, gas flow rate, gas mixture, etc.

Figure 5A:
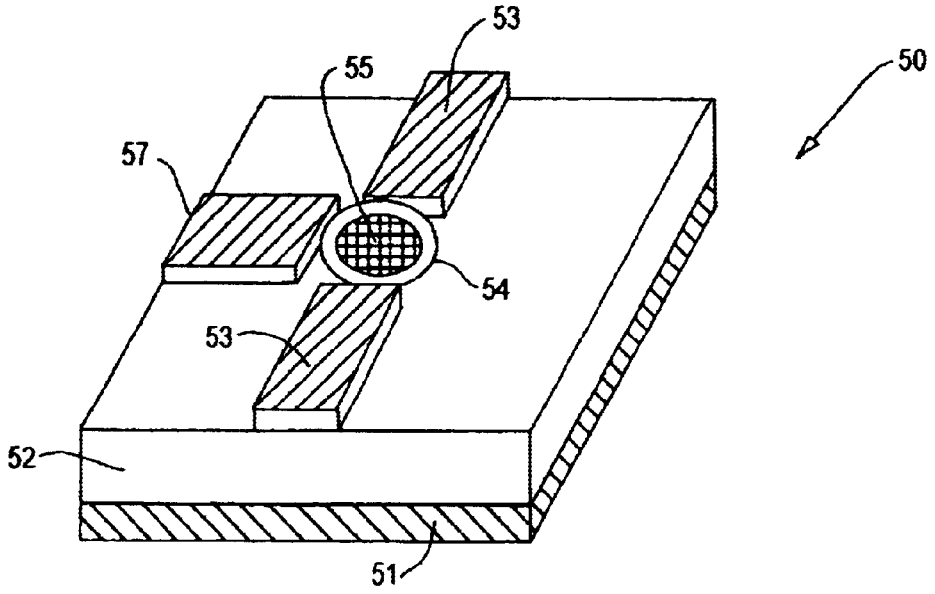
FIG. 5A is a perspective view of an applicator 50 with a series gap 58 in stripline conductor 53 for excitation of plasma discharge 55. Again the electric field is perpendicular to the ion/electron density gradient. Note that the discharge (55) is placed in a standing wave electric field minimum between ground 51 and stripline 53. This produces a maximum electric field in the gap 58, which excites the spherical plasma discharge 55. The discharge 55 is spherical but could also excite a plasma slab or plasma cylinder.
Figure 5B:
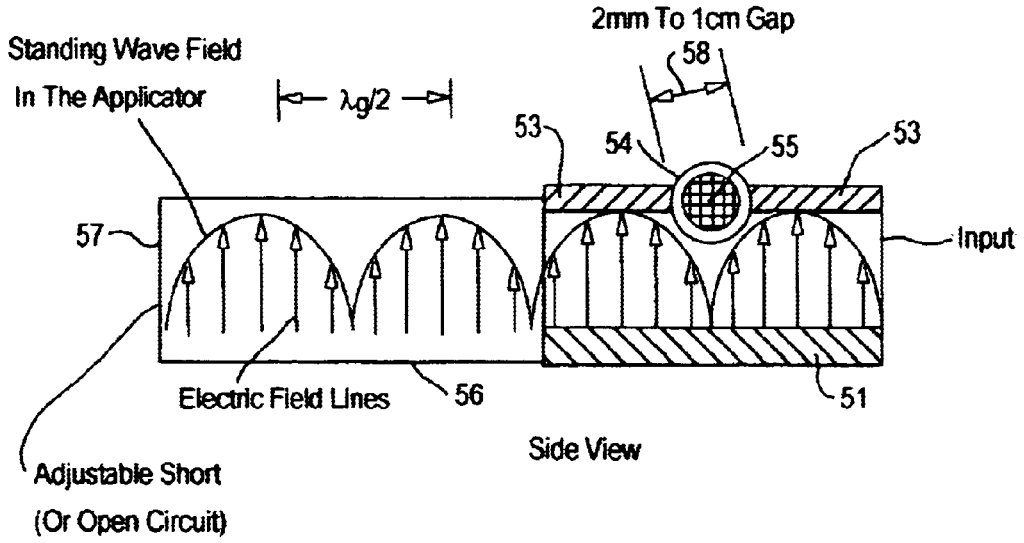
FIG. 5B is a side view of FIG. 5A. An internal or external transmission line circuit 56 is also provided. An open circuit transmission line 57 can be used to conduct the discharge ignition spark (not shown). The length of the line 57 can be adjusted to either be a resonant structure or to be an open circuit when it is not being used as an ignitor region. The gap 58 is less than $\lambda/8$.

The second concept, shown in FIGS. 5A and 5B, is similar to the first except that the container 54 is placed in a gap 58 in the strip conductor 53. Hence the designation "series gap" microwave excitation. The discharge container, shown as a sphere in FIG. 5B, can be located in the gap 58, partially in the dielectric substrate and partially external to the substrate. Other embodiments of this concept include the sphere entirely external to the dielectric substrate or entirely within the dielectric substrate. If the discharge container is a cylindrical rod it then can be placed in the gap with its axis either perpendicular or parallel to the dielectric substrate top surface. Also shown in FIGS. 5A and 5B is an additional (optional) open circuit microstrip transmission 57 located with its propagation axis perpendicular to the main stripline 53. This line 57 is used to provide an initial spark from an external circuit to ignite the microwave discharge. When not in use the line becomes either a parasitic open circuit or could be adjusted in length to be a resonant structure.

Figure 3A:
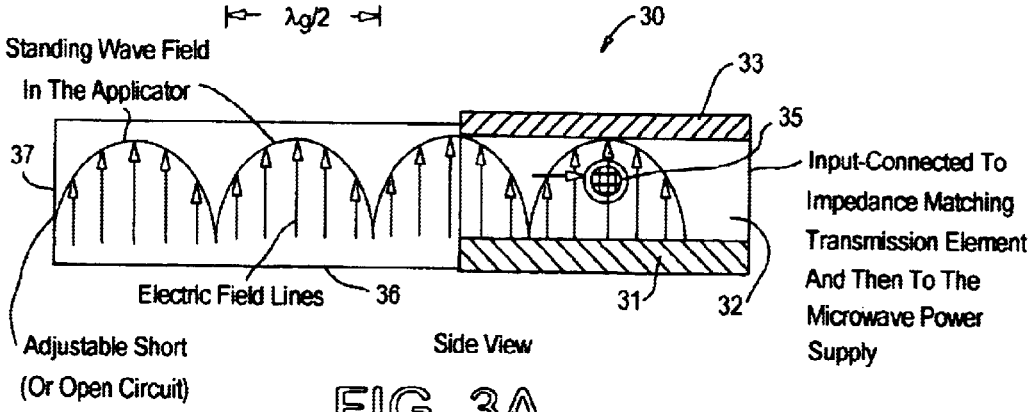
FIG. 3A is a side view of an applicator 30 with a stripline 33 container 34 and plasma 35 and with parallel excitation and a sliding short circuit 37. The transmission line circuit is terminated with a short or open circuit. The distance of the short or open from the plasma discharge 35 region is adjusted so the electric field of the standing wave is a maximum at the location of the discharge 35. This transmission line circuit could be placed internal or external to the stripline 33. A ground 31 and dielectric 32 are also shown.
Figure 3B:
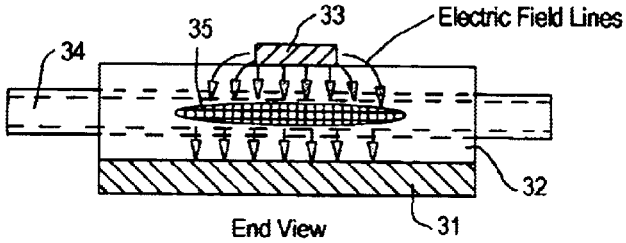
FIG. 3B is an end view of FIG. 3A. The applied electric field is perpendicular to the gradient of the discharge electron density and ion density profile.

Both microstrip applicators shown in FIGS. 3A and 5B utilize an additional either external (as shown in FIGS. 3A and 5B) or internal short circuited (or open circuited) transmission line circuit (37) (57). This circuit is an integral part of the applicator design and must be the appropriate length that provides an impressed electric field maximum at the location of the discharge container. Thus as shown in FIG. 3A the line 36 is terminated in a short circuit (37) at a length that produces an electric field maximum either between the stripline conductors 31 and 33 or in the series gap 58 in FIG. 5B. Thus the short is adjusted to be approximately $\lambda/4$, $3\lambda/4$, $5\lambda/4$, etc. from the discharge for parallel excitation and $\lambda/2$, $\lambda$, $3/2\lambda$, etc. from the series gap discharge. This short circuited transmission line could be a fixed length line or it could be tunable to allow for optimal coupling.

The input end of the microstrip circuit is connected to a microwave oscillator or power supply. This could be a direct connection or a connection with additional circuit elements like a circulator and additional matching stripline circuits. When the additional microstrip matching circuits are included the stripline applicator then becomes a resonant transmission circuit.

It is useful to note that in both applicators, $\lambda_g$, i.e. the stripline wavelength, is much greater than the dimensions of the discharge container and the discharge. Also the electric field impressed on the discharge has components that are both perpendicular or parallel to the discharge density gradients. This insures excellent microwave coupling over a wide range of pressures.

In order to more completely understand the microwave coupling to small ($\lambda_g$, $\lambda >> d$) resonantly sustained discharges, consider the case of low pressure coupling to the parallel excitation of the cylindrical discharge shown in FIGS. 2A to 4B. For simplicity we consider only the coupling to the cold plasma resonance and thus we assume only that the discharge can be accurately modeled with cold plasma theory, i.e. the electron temperature is zero, $T_e=0$.

Figure 6C:
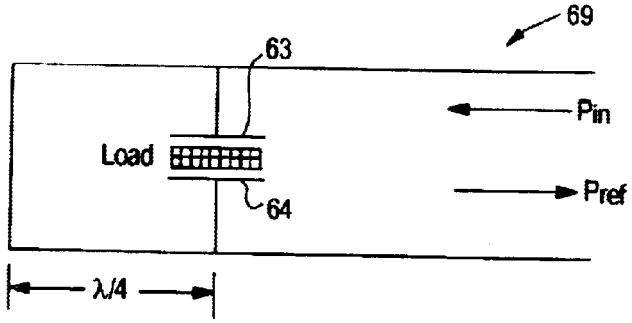
FIG. 6C is a circuit diagram which shows FIG. 6A as an equivalent transmission line.
Figure 6A:
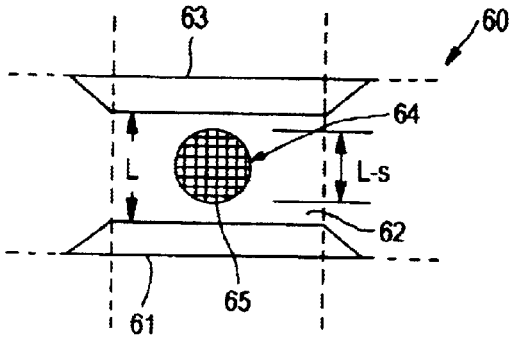
FIG. 6A is a side view of an applicator 60 with the discharge in a stripline 63. The discharge sheath length and container 64 wall thickness are S/2. Typically S/2 varies from 2 to 100 microns.
Figure 6B:
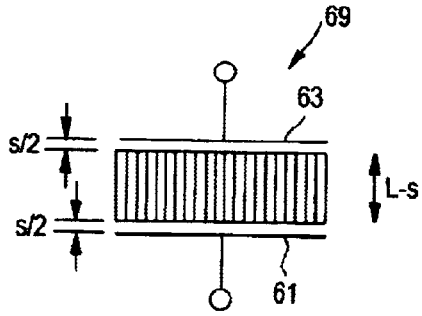
FIG. 6B is a diagram which shows the applicator 60 as a plasma field capacitor.

Additionally we approximate the geometry as a one dimensional parallel plate discharge as shown in FIGS. 6A, 6B and 6C.

Figure 4A:
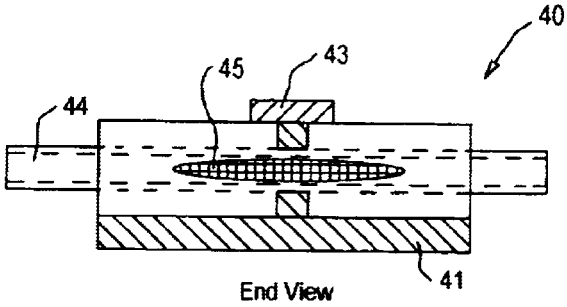
FIG. 4A is an end view of an applicator 40 with a ridge guide as a stripline 43 for electric field focusing and matching into the tube 44 to form the plasma 45. A ground plane 41 and dielectric 42 are also provided.
Figure 4B:
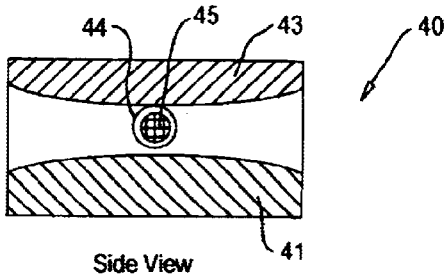
FIG. 4B is a side view of FIG. 4A.

The stripline circuit is terminated with a sliding short and the stripline can either be placed as shown in FIGS. 2A to 4B or a ridged guide 43 as shown in FIG. 4A. The appropriate adjustment of the sliding short is to place the standing wave electric field maximum at the location of the discharge container. Thus the position of the sliding short is adjusted so that the waveguide admittance at the location of the discharge is zero, i.e. the short circuit is reflected to an open circuit at the location of the discharge. Thus if the length of the transmission line is $\lambda/4$, $3\lambda/4$, $5\lambda/4$, etc. a maximum electric field strength is impressed on the discharge zone.

As shown in FIGS. 6A and 6B the region of the discharge and the ridged stripline 63 can be approximated by a plasma 69 filled capacitor. The separation of the capacitor plate is L and adjacent to the top and bottom plates are capacitive dielectric and plasma sheath regions of thickness s/2. Thus the stripline circuit can be replaced by the equivalent transmission line circuit shown in FIG. 6C. Since the admittance of the shorted transmission line is an open circuit at the discharge location the admittance is just the admittance of the plasma capacitor. Assuming a cold plasma model the plasma permittivity, art has the form $$\varepsilon_r = \left(1 - \frac{\omega_{pe}^2}{\omega^2 - \nu_{eff}^2}\right) - j\frac{\nu_{eff}}{\omega}\frac{\omega_{pe}^2}{\omega^2 - \nu_{eff}^2}$$

Thus the plasma capacitor admittance becomes $$Y \sim j\omega C \frac{\omega^2 - \nu_{eff}^2 - \omega_{pe}^2(1 - j\nu_{eff}/\omega)}{L/s(\omega^2 - \nu_{eff}^2) - \omega_{pe}^2(1 + j\nu_{eff}/\omega)}$$

where C is the capacitance of the free space/sheet dielectric region surrounding the discharge. The equation indicates that if $\nu_{eff} << \omega$, the admittance has a resonance when $(\omega_{pe}/\omega)^2 = L/s$.

This resonance is produced by the inductance of the over dense plasma and the capacitance of the free space (dielectric) and sheath regions. Since this resonance is related to the discharge size L and the non-plasma region s, the appropriate adjustment of this ratio together with the adjustment of the transmission line characteristic impedance provides the efficient coupling to the discharge. A similar but more detailed analysis which includes the influence of the cylindrical geometry and the dielectric constant, $K_{eff}$, of the surrounding media yields $$\left(\frac{\omega_{pe}}{\omega}\right)^2 = (1 + K_{eff})^{1/2}$$

for the cylindrical discharge container.

FIGS. 7 to 14 show variations of the basic stripline for plasma discharge creation.

A. Placement of the Discharge Container Relative to the Stripline.

Figure 7:
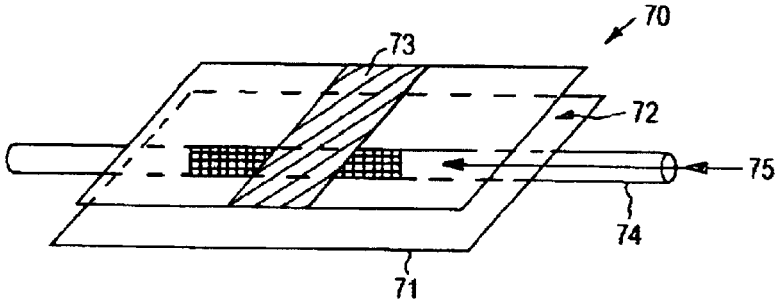
FIG. 7 is a schematic perspective view of a basic stripline in an applicator 70 of the present invention. The elements are ground 71, dielectric 72, stripline 73, tube 74 and plasma 75.

FIG. 7: Discharge between stripline and ground plane, and the plasma tube is in the plane of the ground plane and perpendicular to the stripline.

A plasma discharge is produced inside a dielectric tube using a microstrip transmission system as shown in FIG. 7. The system is operated at 2.45 GHz in the demonstration, but it would work from 300 MHz to 10's GHz.

The microwave power is coupled to the stripline with the lower plate serving as the ground plane. A plasma discharge is ignited in the hollow dielectric tube. Example materials for the discharge container include glass, quartz, ceramic, polymers, as well as other dielectric materials. The plasma is contained in the tube and it occupies a length of the tube that ranges from a small plasma just under the stripline, to a longer plasma that can extend the full length of the dielectric tube. The length of the plasma discharge increases as the power to the circuit is increased. This type of discharge can be called a plasma resonant discharge or plasma wave discharge.

Figure 8:
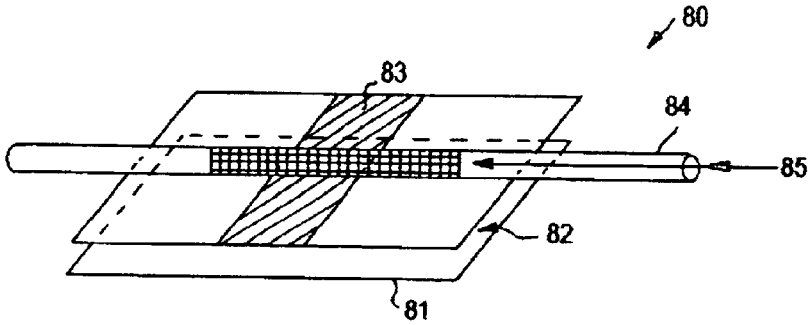
FIG. 8 is a perspective view of an applicator 80 where the discharge 85 is above the stripline 83 and ground plane 81 and the plasma tube 84 is in the plane of the ground plane 81 and perpendicular to the stripline 83.

FIG. 8 shows discharge above the stripline and ground plane, and the plasma tube is in the plane of the ground plane and perpendicular to the stripline.

Figure 9:
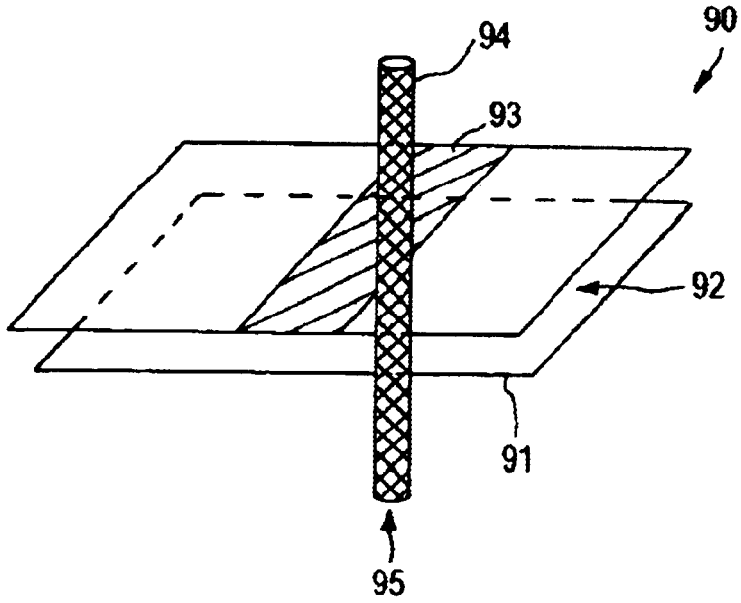
FIG. 9 is a perspective view of an applicator 90 where the discharge 95 is beside and perpendicular to the stripline 93 and ground 91 in tube 94. The dielectric 92 is between the ground 91 and the stripline 93.

FIG. 9 shows a discharge container beside and perpendicular to the stripline and ground.

Figure 10:
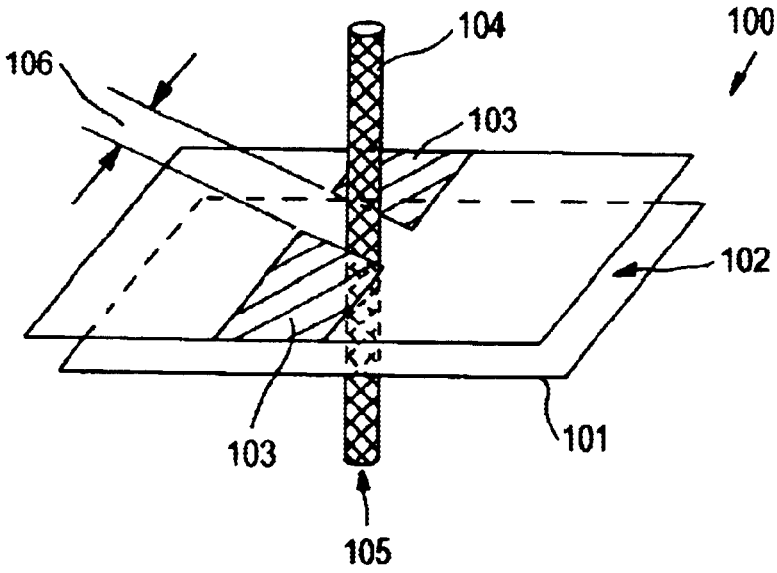
FIG. 10 is a perspective view of an applicator 100 where the tube 104 is placed in a gap 106 on the stripline 103. The dielectric 102 is between the ground 101 and the stripline 103.
Figure 13:
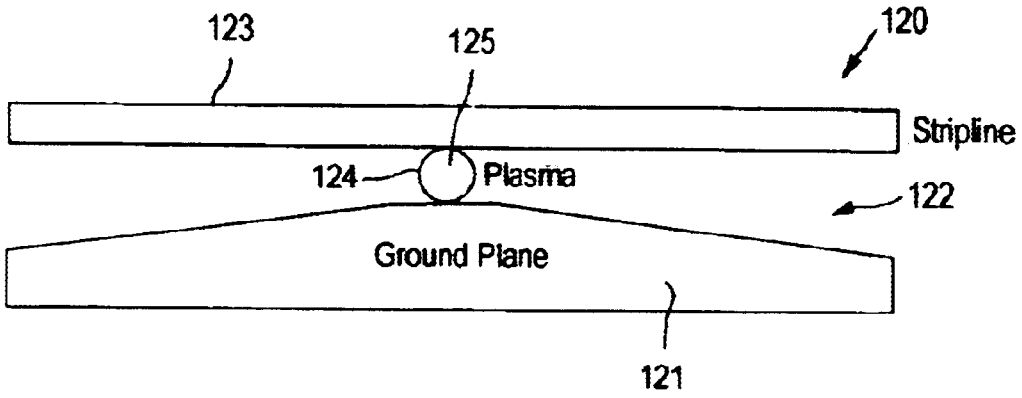
FIG. 13 is a side view showing an applicator 120 with ground 121, dielectric 122, stripline 123, tube 124 and plasma discharge 125.

FIG. 10 shows the tube that in this case is placed in a gap on the stripline. The electric field lines in this case not only extend from the stripline to the ground plane, but also across the gap in the stripline.

Thus the tube can also be placed vertically as shown in FIGS. 9 and 10 or the tube can be placed parallel to the ground plane as shown in FIGS. 7 and 8.

FIG. 12 shows a microstrip resonator that is then used to couple energy to the plasma discharge. The basic configuration of a stripline resonator is a resonant structure formed by a metal element separated from the ground plane by a dielectric layer. Common resonant structure shapes include rectangles and circles as shown in FIGS. 11A to 11C. Only the top metal microstrip structure is shown; the ground plane is not shown. The power is coupled to the resonator from a stripline connected to a microwave power supply. The coupling occurs via capacitive coupling from the stripline to the resonant structure. The resonant frequency of the resonator depends on the size and shape of the structure and on the dielectric material properties. The plasma discharge container in this variation can be placed either adjacent to the stripline resonator or in the space between the top plate of the resonator and the ground plane. The stripline resonators operate so that they have an increased electric field and a variable impedance at specific resonant frequencies.

The hollow tube can be replaced by a variety of other shaped dielectric boundaries/shapes besides the straight cylindrical tube. Possible plasma containing containers include a sphere, cylinder (with ends), rectangular volume, elliptical volume, tubes in loop shapes—(circles, triangles, squares, etc.), tubes with Y and T shapes, tubes in helix shapes, tubes with circular, rectangular and other cross-sections, and other irregular and arbitrary shapes. In each of these cases the plasma can occupy the dielectric bounded container for significant distances beyond the electromagnetic excitation region just adjacent to the stripline because the microwave energy can travel along the plasma/dielectric boundary.

The microwave power input provides the energy for the discharge to operate. To improve the ignition and subsequent operation of the discharge various techniques exist to increase the microwave electric field strength in the region where the stripline overlaps/interacts with the plasma tube. These include: a) narrowing the distance from the stripline and the ground plane (a ridge waveguide structure—FIG. 13), b) narrowing the width of the stripline, and c) using two striplines with a 180 degree phase delay in one of the lines. Another technique that creates larger microwave electric field is a resonant structure formed from a stripline as described above and shown in FIGS. 11 and 12.

Variation in the Tuning to Ignite Plasma and to Maximize the Power Coupling from the Microwave Power Supply to the Plasma Discharge.

Variation 1: Tuning techniques for getting a maximum electric field at the plasma discharge tube location. Technique 1 is to feed the power at one end of the stripline and put a tunable short at the other end of the stripline. The tunable short creates a microwave standing wave along the stripline (as shown in FIG. 4A) and the tuning of the short moves the peak electric field location so that it can be aligned with the plasma tube location. The short can also be fixed to always create the peak electric field at a fixed location. The tuning short can be implemented either as an external element or in the stripline itself.

Figure 14:
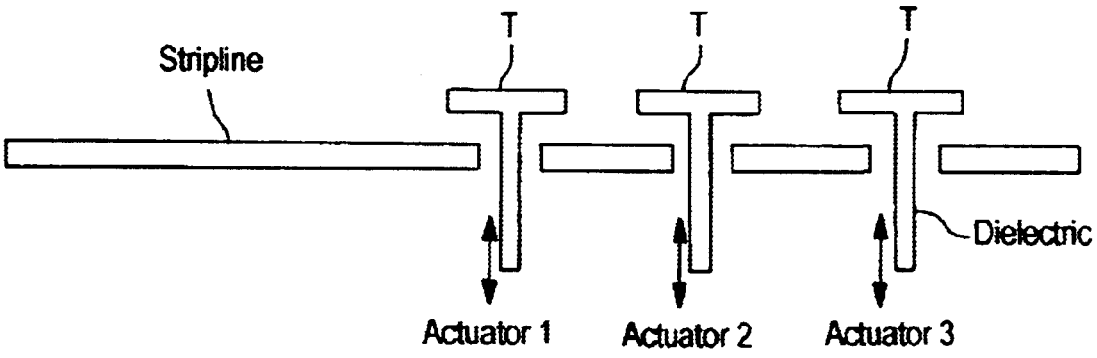
FIG. 14 shows various tuning stubs T which can be used.

Variation 2: Variable tuning. Stripline tuning stubs can be used with a variable length done via an actuator as shown in FIG. 14. By closing a discrete number of actuators the length of the tuning stub is adjusted. By partially closing one of the actuators, a variable capacitance is introduced that acts as a variable length tuning. The actuator could be one using a MEMS design to create the actuator structures. Also an electronically adjustable capacitor can be used to change the effective tuning stub length. Tuning can also be accomplished by changing the frequency of the exciting microwave energy.

Variation 3: More than one tuning element can be included in the microwave circuit. The tuning elements are used to both position the location of the electric field maximum at the location of the plasma discharge container and to maximize the percentage of the power from the microwave power supply that is delivered to the discharge.

Arrays of these miniature plasma discharges can be created. The microwave power can be supplied from either one power supply with the power distributed to multiple plasma discharges. Or, each plasma discharge can be supplied by a separate microwave power generator. There is also the configuration where the microwave power travels along a bounded plasma discharge to be coupled to a different separate and distinct plasma discharge via microwave power coupling from one discharge to another.

The microwave power supply can be either located on the same structure (for example the same printed circuit board) as the plasma source using a solid state microwave circuit to supply the power or the power can be delivered from a separate power supply using a coaxial cable of waveguide structure.

The microwave excited miniature and micro plasma discharges have a number of possible applications. Most of the applications center on the use of these plasmas in micro systems such as lab-on-a-chip and other MEMS devices. Specific applications include:

1) Miniature ring or multi-pass laser cavity spectrometer operating on the intracavity spectrometer principle. This would be a ultrasensitive spectrometer for certain species.
2) Miniature emission spectroscopy plasma source with high sensitivity because of long optical path and high electron temperature.
3) Miniature or on-chip UV light source. A long plasma would produce an intense light along the direction of the tube.
4) Spectrometer system with different size plasma tubes giving plasmas of different electron temperature/power densities. This will allow a spectrometer system with a greater sensitivity to specific species.
5) Use the plasma resonant discharge to distribute power to a number of individual plasma from a single microwave power source.
6) Use the miniature plasma to clean, decontaminate, sterilize or coat the inside of micro-fluidic and/or MEMS structures of arbitrary shapes.
7) Use discharges to put protective coatings on the inside of structures, especially gas and liquid flow structures. Also inside gas and liquid flow structures on MEMS chips.
8) The plasma source can be used to destroy chemically and biologically hazardous materials that may be created by lab-on-chip and other miniature laboratory devices.
9) The plasma source can be the source of heat for lab-on-a-chip and other MEMS structures. The plasma discharge can provide high temperatures, and temperature profiles that are adjustable and shaped.
10) Miniature, electrodeless lighting source. Intense and very small few 10's microns to millimeter size plasmas of spherical, cylindrical, and other shapes can be created and used as lighting sources.
11) Miniature vacuum pump for use in microsystems.
12) Miniature gas flow controller for use with MEMS and system-on-a chip (SOC).

Figure 15:
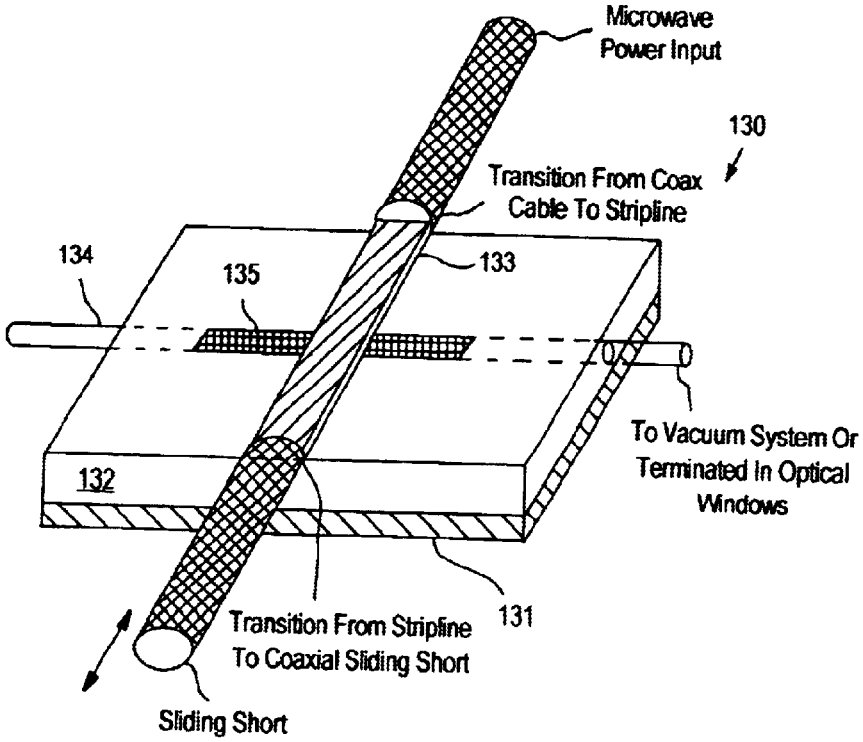
FIG. 15 is a perspective view of a perspective stripline 133 applicator 130 with a 1 mm ID tube as a discharge 135 container 134.
Figure 16:
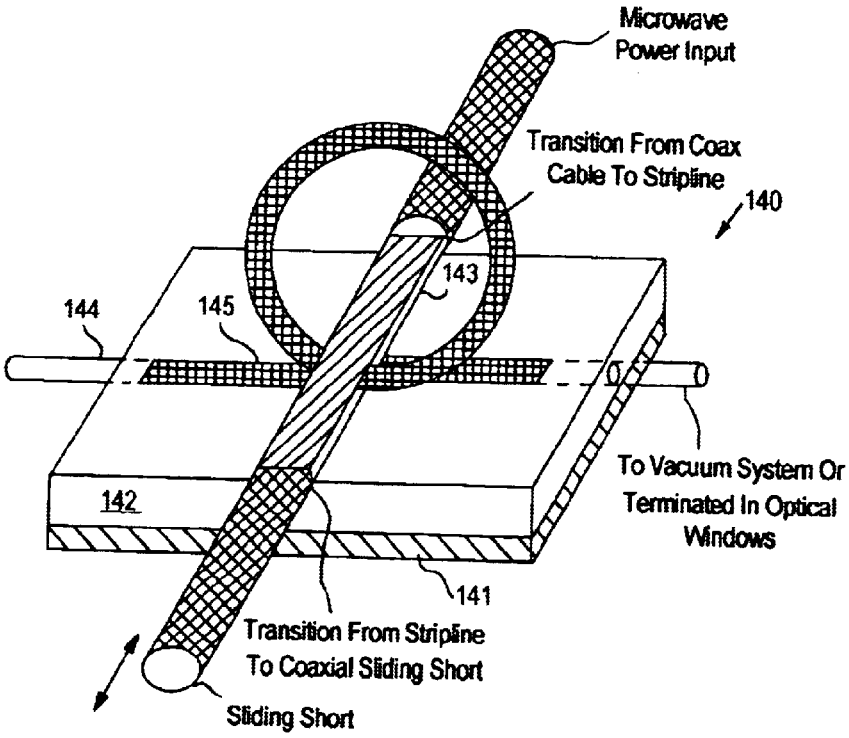
FIG. 16 is a perspective view of a stripline 143 applicator 140 with a loop in the tube 144 containing the plasma 145.

FIG. 15 shows an applicator 130 as tested. FIG. 16 shows a variation with a loop in the tube 144.

Figure 17:
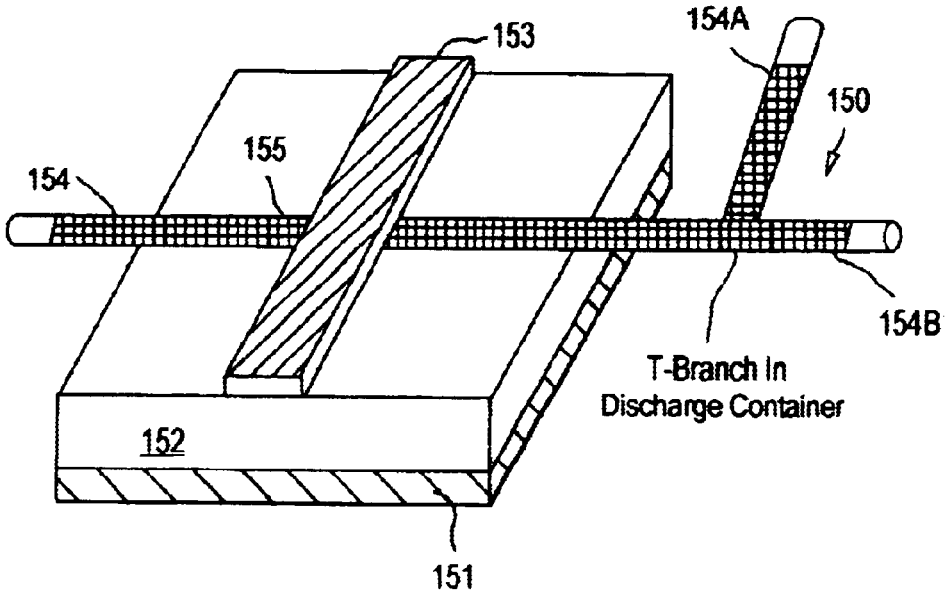
FIG. 17 is a perspective view of a stripline 153 an applicator 150 with a branch in tube or container 154 filled with the plasma 155.

The container that confines the plasma discharge can be formed in a variety of shapes as shown in FIG. 17. This container 154 and discharge 155 can extend long distances from the plasma discharge excitation region located where the container 154 (e.g. channel or tube) is adjacent to the stripline 153 in the stripline applicator 150. The container 154 can be partially or fully filled with a discharge depending on the input microwave power. Specifically, more power yields a larger region of the container 154 filled with plasma discharge. In cases such as tubes and channels 154 the plasma discharge 155 is excited away from the stripline 153 excitation region via a traveling microwave field that follows the discharge. This wave is bounded to the plasma discharge 155. These bounded traveling waves can be used to extend the plasma discharge from the initial channel/tube 154 into two or more branches 154A and 164B of the initial channel/tube 154. The branching can be at arbitrary angles i.e. the branching can be in "T" and "Y" shapes. This capability of extending a. plasma 155 discharge excited at one location into one or more branches of the container 154 allows extended networks of connected tubes/channels to be filled with a plasma discharge. These tubes or channels 154 can also be formed into bends and loops, and the bends and loops can be filled with the discharge 155 just as a straight tube/channel 154 section. The ground conductor 151 is separated by a dielectric 152 from the stripline 153.

Figure 18:
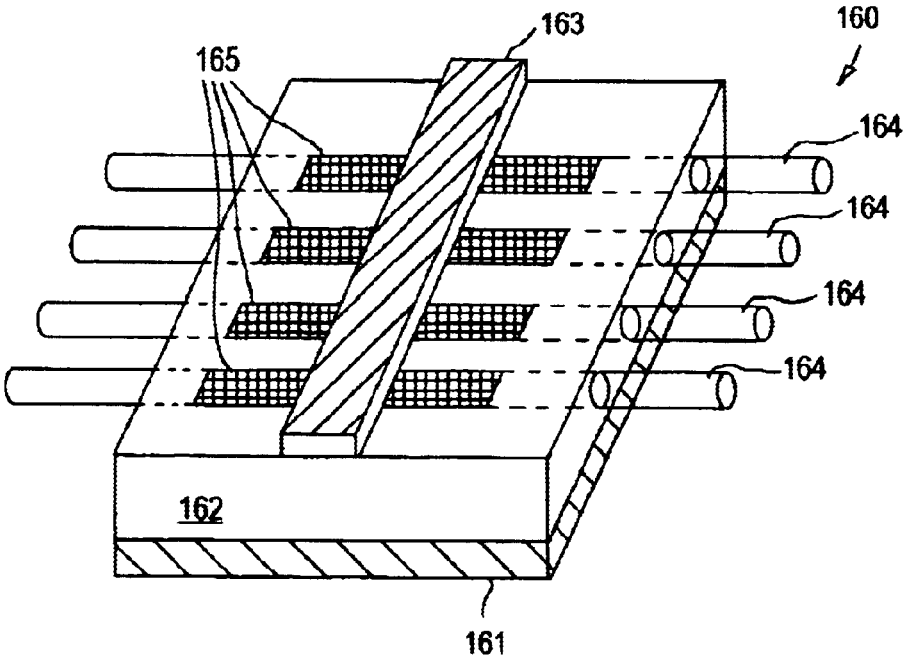
FIG. 18 is a perspective view 160 of a single stripline 163 applicator where multiple tubes 164 in an array are excited.

FIG. 18 shows an array of four of tubes 164 containing the plasma 165 and activated by one stripline 163. The ground 161 is separated by a dielectric 162.

The stripline is designed (tuned) to place the discharge in a region of high electric field, i.e. the stripline applicator focuses the electric field into the discharge zone. The stripline applicator can have the capability to adjust the location of the high electric field. The plasma containers are located in a region of high electric field.

Specific aspects of the present invention are:

A) The length of the stripline structure can be adjusted to position the maximum of the microwave electric field at the location of the microwave transparent container where the plasma is formed. This length adjustment also allows the maximization of the microwave power coupled into the plasma.

B) The primary microwave electric field that drives the plasma can be either (1) from the conducting plate to the ground conductor or (2) across a gap in the conducting plate.

C) The microwave waveguide structure is used to couple microwave energy across a capacitive gap into a resonant structure formed by a metal plate located above a metal ground plate. The space between the metal plate and the metal ground plate is filled with a dielectric and/or air. The microwave lossless container is located either between the conductors or adjacent to the conductors or in a conductor gap.

D) The container can be a network of tube shapes of various cross-sectional shapes including circular, rectangular, square and elliptical cross-sections with the various tubes connected with angled corners, T and Y shaped branches, and curved regions.

E) The network of tubes described in D) can be constructed to interconnect volume regions/containers that are of sizes less than 1 cubic centimeter with shapes including rectangular boxes, ellipsoids, spheres, cylinders and irregular shapes.

F) The volumes on E can be arranged into one-, two-, or three-dimensional arrays or arranged in a random spatial pattern with the volumes themselves being of a repeated, specified size or random, irregular shapes.

G) The network of tubes described in E) serves to transmit the microwave power from one volume to the next so that a plasma is formed in the network of tubes and in each of the volumes.

H) The microwave energy to excite the network of tubes originates from the excitation of as few as one tube container. The tube or tubes used to couple power to the plasma from the microwave power supply are of the container type, the other tubes and volumes can be bounded by either microwave transparent materials or microwave conduction materials. (Filling tube networks on MEMS and system-on-chip (SOC) applications).

I) The container can be optically transparent for a portion of its surrounding surface. (Light source, spectrometer light source, sterilization light source).

J) The apparatus can have an end of the tube which is optically transparent. Optical region is defined as infrared, visible and ultraviolet light. (Spectrometer application).

K) The operation of the apparatus is with a controlled microwave power magnitude so that the container can be partially or completely size filled with plasma. In the case of partially filled the microwave power magnitude determines the size or percentage of volume filled with plasma.

L) The operation of the apparatus can be with a controlled microwave power magnitude so that the heat generated by the plasma in the container and its variation can be controlled via the input microwave power.

M) The operation of the apparatus can be with a controlled microwave power magnitude so that the light intensity from the plasma in the container can be controlled via the input microwave power.

N) The operation of the apparatus can be with a controlled microwave power magnitude so that the plasma species production in the container can be controlled via the input microwave power.

O) The controlling parameters (in addition to or in substitution of the microwave power magnitude) includes the gas pressure in the container, the gas flow rate into the container, and/or the gas composition into the container.

P) The tube can be bent into specific shapes including a helix, loop, rectangle, and triangle.

Q) The apparatus can have two openings with one being for the inflow of gas and the other for the outflow of gas. The outflow opening is positioned and sized so that the plasma discharges produces a flux through this opening that has a high directed velocity. (microthruster, microtorch).

It is intended that the foregoing description be only illustrative of the present invention and that the present invention be limited only by the hereinafter appended claims.

We claim:

1. An apparatus for maintaining microwave plasma discharge which comprises:

a container transparent to microwave energy and having an internal section of 1 cm or less in width, which container is positioned in a dielectric material between conductors which serve as a guide for the microwave energy and as plates for providing an electrical field and microwave power coupling with an electrical stripline conductor less than about 3 mm thick and less than 2 cm wide providing one of the conductor plates mounted on the container transverse of the container cross-section, wherein the plasma is maintained inside the container by the microwave energy in the presence of a gas which when ionized forms the plasma discharge in the container.

2. The apparatus of claim 1 wherein the container is a tube which has a length which is longer than the width and wherein the tube extends beyond the stripline conductor width.

3. The apparatus of claims 1 or 2 wherein the stripline conductor is a strip of metal mounted on the dielectric material which is a solid and adjacent the container and wherein another of the conductors mounted on the dielectric material is a ground plate.

4. The apparatus of claims 1 or 2 wherein the conductor is a strip of metal which has a length which is greater than the width of the container.

5. The apparatus of claim 1 wherein the container is a sphere.

6. The apparatus of claim 1 wherein the dielectric material is a gas.

7. The apparatus of claim 1 wherein the dielectric material is a solid.

8. The apparatus of claims 1 or 2 wherein the plasma discharge is excited so that the discharge is maintained at plasma resonance, geometric plasma resonance or combinations thereof.

9. The apparatus of any one of claims 1, 2 or 5 where there are more than one of the apparatus for maintaining the microwave plasma discharge, where individual discharges are powered from a single source for the microwave energy and where the individual discharges are sustained by the microwave energy coupling from discharge to discharge.

10. The apparatus of any one of claims 1, 2 or 5 where the container is placed in a gap of the stripline conductor and the gap length is less than $\lambda/8$.

11. The apparatus of any one of claims 1, 2 or 5 where one or more discharges are present at power levels less than 100W for pressures in the container from 0.01 Torr to above one atmosphere.

12. The apparatus of any one of claims 1, 2 or 5 where the plasma discharge extends beyond the width of the stripline conductor, so that direct microwave excitation by the stripline conductor occupies a small fraction of a discharge volume in the container and wherein optionally there is a gap in the stripline and the gap is less than $\lambda/8$.

13. The apparatus of claim 1 wherein the container or a portion of the container is placed in the electric field created by the stripline conductor.

14. The apparatus of claim 1 where the stripline conductor is shaped and sized to form a resonant element which produces electric fields in all or a portion of the container.

15. The apparatus of any one of claims 1, 2 or 5 wherein the container on one or both sides of the stripline conductor is divide into two or more container sections or branches so that the plasma discharge fills the two or more container sections or branches and wherein optionally there is a gap in the conductor and the gap is less than λ/8.

16. The apparatus of any one of claims 1, 2 or 5 wherein the container contains the gas that is at a pressure from 0.01 Torr to above one atmosphere and wherein the gas can be flowing through the container or stagnant.

17. The apparatus of claim 1 where the conductor is shaped and sized to form a resonant element which produces electric fields in all or a portion of the container and where a resonant and match structure is created by the addition of tuning circuits between the microwave power supply and resonant element.

18. The apparatus of any one of claims 1, 2 or 5 where the microwave energy is supplied directly to the stripline structure without any matching elements and wherein optionally the container is placed in a gap of the stripline conductor and where the gap is less than λg/8.

19. The apparatus of claim 15 wherein sections of the container are in curved or bent shapes.

20. The apparatus of any one of claims 1, 2 or 5 where the stripline conductor is terminated in an electrical or mechanically tunable adjustable load and wherein optionally there is a gap in the stripline conductor and where the gap is less than λ/8.

21. The apparatus of any one of claims 1, 2 or 5 where a tunable element is adjusted for plasma discharge ignition and maintenance and where the stripline conductor is terminated in an electrically or mechanically tunable (adjustable) load.

22. The apparatus of any one of claims 1, 2 or 5 where an amount of power input is used to control a region or length of the container occupied by the discharge and wherein optionally there is a gap in the stripline conductor and the gap is less than λ/8.

23. The apparatus of claims 1, 2 or 5 wherein plural of the apparatus are arranged in an array pattern.

24. The apparatus of claims 1, 2 or 5 where there is more than one of the apparatus for maintaining the microwave plasma discharge and where individual discharges are powered from a single source for the microwave energy.

25. In a method for producing a plasma discharge, the improvement which comprises exciting the discharge in an apparatus which comprises:

(a) a providing a container transparent to microwave energy and having an internal section of 1 cm or less in width, which container is positioned in a dielectric material between conductors which serve as a guide for the microwave energy and as plates for providing an electrical field and microwave power coupling with an electrical stripline conductor less than about 3 mm thick and less than 2 cm wide providing one of the conductor plates transverse of the container cross-section; and (b) maintaining the plasma inside the container by the microwave energy in the presence of a gas which when ionized forms the plasma discharge in the container.

* * * * *

UNITED STATES PATENT AND TRADEMARK OFFICE

CERTIFICATE OF CORRECTION

PATENT NO. : 6,759,808 B2 
DATED : July 6, 2004
INVENTOR(S) : Timothy A. Grotjohn, Jes Asmussen and Andy Wijaya It is certified that error appears in the above-identified patent and that said Letters Patent is hereby corrected as shown below:

Title page,
Item [56], References Cited, OTHER PUBLICATIONS, please insert
-- Tonks, Phys. Rev. 38, 1219 (1931);
Parker, J.V., et al., Phys of Fluid, 7, 1489 (1964);
Parker, J.V., et al., Phys Rev. Letters 11, 183 (1963);
Taillet, J., Am. J. Phys., 37, 423 (1969);
Romell, D., Nature, 167, 243 (1951);
Tonks, L., et al., Phys Rev. 34, 876 (1929);
Leavens, W.M., Radio Science, 69D, 10, (1964) 1321; Phys., Fluid, 10, 2708 (1967);
D.E. Baldwin, Phys. Fluid 12, 279 (1969);
Fredericks, R.M., et al., "Returning and Hysteresis …" J. Appl. Phys. 42, 3647-3649 (1971);
Fredericks, R.M., et al., "A High density resonantly sustained plasma in a variable length cylindrical cavity," Appl. Phys Letters, 19, 508-510 (1971);
Asmussen, J., et al., Proc. IEEE 62, 109 (1974);
Roger, J., and J. Asmussen, IEEE Trans on Plasma Science PS-10, 11-16 (1982);
Fredericks, RM., Ph.D. Thesis, MSU (1971); and
Bilgic et al., Plasma Sources Sci. Technol. 9, 1-4 (2000). --

Column 13,
Line 24, "art has the" should be -- $\varepsilon_r$, has the --.

Column 19,
Line 3, "is divide into" should be -- is divided into --.

Column 20,
Line 17, "(a) a providing" should be -- (a) providing --.

Signed and Sealed this

Twenty-first Day of December, 2004

JON W. DUDAS
*Director of the United States Patent and Trademark Office*